US005864792A

United States Patent [19]

Kim

[11] Patent Number: 5,864,792

[45] Date of Patent: Jan. 26, 1999

[54] SPEED-VARIABLE SPEECH SIGNAL REPRODUCTION APPARATUS AND METHOD

[75] Inventor: Chul Hong Kim, Suwon, Rep. of Korea

[73] Assignee: Samsung Electronics Co., Ltd., Kyungki-do, Rep. of Korea

[21] Appl. No.: 695,776

[22] Filed: Aug. 12, 1996

[30] Foreign Application Priority Data

Sep. 30, 1995 [KR] Rep. of Korea ..... 1995-33520

[51] Int. Cl.[6] ..... G10L 3/02

[52] U.S. Cl. ..... 704/208; 704/214

[58] Field of Search ..... 704/267, 258, 704/207, 201, 208, 216

[56] References Cited

U.S. PATENT DOCUMENTS

| | | | |
|---|---|---|---|
| 3,786,195 | 1/1974 | Schiffman | 360/25 |
| 3,828,361 | 8/1974 | Schiffman | 360/25 |
| 4,301,480 | 11/1981 | Kitamura | 360/8 |
| 4,365,115 | 12/1982 | Nagata et al. | 395/2.16 |
| 4,406,001 | 9/1983 | Klasco et al. | 369/88 |
| 4,696,039 | 9/1987 | Doddington | 704/215 |
| 4,700,391 | 10/1987 | Leslie, Jr. et al. | 395/2.16 |
| 4,903,301 | 2/1990 | Kondo et al. | 704/201 X |
| 5,341,432 | 8/1994 | Suziki et al. | 395/2.2 |
| 5,548,690 | 8/1996 | Shimada | 395/112 |
| 5,574,823 | 11/1996 | Hassanein et al. | 395/2.17 |
| 5,630,012 | 5/1997 | Nishiguchi et al. | 395/2.17 |
| 5,630,013 | 5/1997 | Suzuki et al. | 395/2.25 |
| 5,668,924 | 9/1997 | Takahashi | 704/219 |
| 5,717,823 | 2/1998 | Kleijn | 704/220 |
| 5,742,930 | 4/1998 | Howitt | 704/214 X |

FOREIGN PATENT DOCUMENTS

| | | | |
|---|---|---|---|
| 4-168499 | 6/1992 | Japan | G10L 3/02 |

*Primary Examiner*—David R. Hudspeth
*Assistant Examiner*—Scott Richardson
*Attorney, Agent, or Firm*—Sughrue, Mion, Zinn, Macpeak & Seas, PLLC

[57] ABSTRACT

A speed-variable speech signal reproduction apparatus and method for playing back speech signals stored in a storage medium at an adjusted speed while preventing any degradation in tone or loss of the speech signals from occurring. The method includes the steps of detecting the pitch of input digital speech signals using an average magnitude difference function, separating voice and voiceless sounds of the speech signals from each other based on the result of the detecting step, temporarily storing the separated voiceless sound, modulating the lengths of the speech signals by copying or eliminating a part of the separated voice sound, and synthesizing the modulated voice sound step with the voiceless sound temporarily stored in the storing step. The apparatus includes the a detector for detecting the pitch of input digital speech signals using an average magnitude difference function, a device for separating voice and voiceless sounds of the speech signals from each other based on the result of the detecting step, a memory for temporarily storing the separated voiceless sound, a modulator for modulating the lengths of the speech signals by copying or eliminating a part of the separated voice sound, and a synthesizer for synthesizing the modulated voice sound step with the voiceless sound temporarily stored in the storing step.

4 Claims, 4 Drawing Sheets

SPEED-VARIABLE SPEECH SIGNAL REPRODUCTION APPARATUS AND METHOD

BACKGROUND OP THE INVENTION

1. Field of the Invention

The present invention relates to an apparatus and method for use with a speech signal reproduction apparatus such as a tape player, VCR, multimedia equipment, computer or the like, for reproducing speech signals stored in a storage medium at variable speeds while preventing any degradation in tone or loss of the speech signals from occurring.

2. Description of the Related Art

In conventional tape or video players, the reproduced audio tone typically will vary when the play-back speed of the recorded signal is varied. That is, when the play-back speed is high, the audio signal being played back will vary from its original audio level and is heard as a "peep-peep" sound. At a low play-back speed, however, the audio signal will have what is known as a "loosened tape sound".

These phenomenons occur because the levels of frequency and pitch components of the recorded audio signal varies in relation to a variation in the play-back speed of the audio signal. A conventional method for preventing such phenomenons by partially playing back audio signals which have been read into a memory buffer is set forth in Japanese Patent Laid-Open Publication No. Heisei 4-168499 (Jun. 16, 1992). In accordance with this method, when the play-back speed is doubled, the audio signals that were read into the memory buffer are partially played back in such a way that only one of each of its two successive time-slices is played back.

For example, when a vocal recording of "I go to school with Jane" is played back at double speed in accordance with this conventional method, components of the original speech signal, which respectively correspond to the shaded portions shown in FIG. 1, are eliminated, so that only the speech "I to with Jane" is reproduced. Hence, since the conventional method plays back only a portion of the speech at a higher play-back speed so as to keep the tone of the speech in tact, the original meaning of the speech is lost. As a result, it is very difficult to understand the meaning of the speech using this conventional reproduction method.

SUMMARY OF THE INVENTION

An object of the present invention is to solve the above-mentioned problem by providing a speed variable speech signal reproduction method and apparatus capable of playing back speech signals stored in a storage medium at varied speeds while preventing any degradation in tone or loss of the speech signals from occurring.

In particular, the present invention provides a speed-variable speech signal reproduction method using a signal processor adapted to receive and process digital speech signals, a memory adapted to store the digital speech signals processed by the signal processor, and a microcomputer adapted to control both the signal processor and memory. The method comprises a first step of detecting a particular pitch of the digital speech signals using an average magnitude difference function (AMDF), a second step of separating voice and voiceless sounds of the speech signals from each other based on the pitch detected in the detecting step, and a third step of temporarily storing the voiceless sound separated from the voice sound in the separating step. The method further comprises a fourth step of copying or eliminating a part of the voice sound separated in the second step to modulate the lengths of the speech signals, and a fifth step of synthesizing the voice sound modulated in the fourth step with the voiceless sound temporarily stored in the memory during the third step.

Similarly, the apparatus of the present invention comprises a detector for detecting a particular pitch of the digital speech signals using an average magnitude difference function (AMDF), a separator for separating voice and voiceless sounds of the speech signals from each other based on the pitch detected in the detecting step, and a memory for temporarily storing the voiceless sound separated from the voice sound in the separating step. The apparatus further comprises a modulator for copying or eliminating a part of the voice sound separated in the separator to modulate the lengths of the speech signals, and a synthesizer for synthesizing the voice sound modulated in the modulator with the voiceless sound temporarily stored in the memory.

In accordance with the present invention, it is preferable that the detection of the particular speech signal pitch performed in the first step of the method and in the detector of the apparatus be achieved using the following equation:

$$\Gamma n(k) = \sum_{m=0}^{\infty} |x(n+m)\omega 1(m) - x(n+m-k)\omega 2(m-k)|$$

$$\omega(m) = \begin{cases} 1 & \text{if } 0 \leqq m \leqq N \\ 0 & \text{if not} \end{cases}$$

where,

N: a certain segment of a window function;

m: the sampling position;

k: the time constant corresponding to the particular speech signal pitch to be detected.

Preferably, the second step is performed in such a manner that when speech signals are detected as having a particular pitch in the first step, they are recognized as a voice sound, whereas speech signals which are detected as not having a particular pitch are recognized as a voiceless sound. Such an operation is also performed by the separator apparatus of the present invention.

It is also preferred that the signal modulation performed in the fourth step and in the modulator be achieved by applying a window function, which provides a certain signal length extending from the position of each speech source, to the speech signal portion corresponding to one pitch of voice sounds as indicated by the following equation:

$$x_m(n) = h_m(t_m - n)x(n)$$

where, $x_m(n)$: a modulated speech signal;

$h_m(n)$: the window function;

$t_m$: the position of each speech source; and x(n): an input speech signal (the amount of speech on a time axis n).

Preferably, the synthesis of the modulated voice sound with the voiceless sound carried out in the fifth step and synthesizer is achieved using the following equation:

$$x(n) = \frac{\sum_q \alpha_q x_q(n) h_q(t_q - n)}{\sum_q h_q^2(t_q - n)}$$

where, $\alpha_q$: a variable for adjusting the amount of synthesized speech;

x(n): a modulated speech characteristic ($x(n)=x(n-\delta_q)$);

$t_q(n)$: the position of each modulated speech source; and $\delta_q$: a variable for determining the play-back speed.

BRIEF DESCRIPTION OP THE DRAWINGS

Other objects and aspects of the invention will become apparent from the following description of embodiments with reference to the accompanying drawings, in which.

Figure 1:
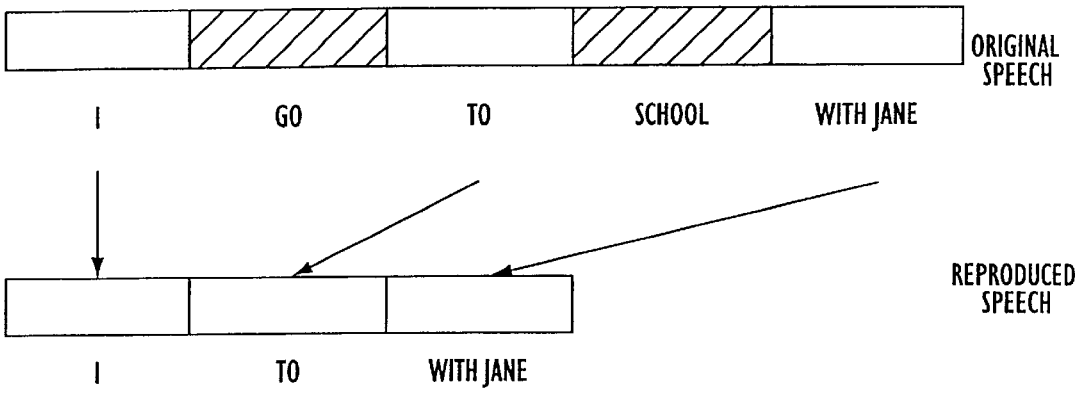
FIG. 1 is a diagram for explaining a conventional speed-variable speech reproduction method.
Figure 2:
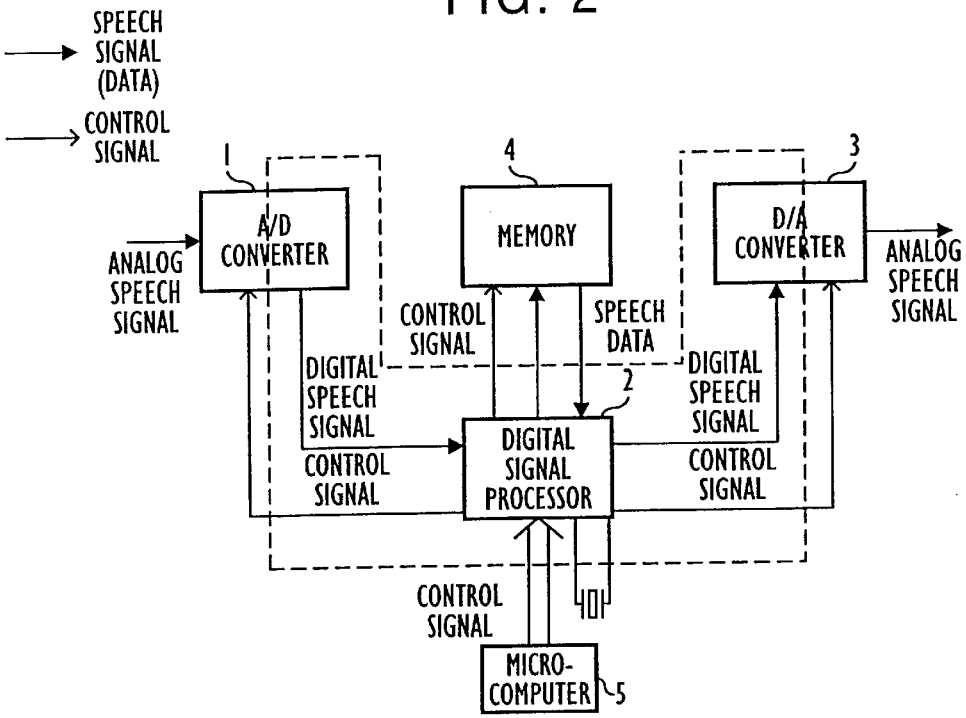
FIG. 2 is a block diagram schematically illustrating a speed-variable speech signal reproduction apparatus in accordance with an embodiment of the present invention which performs a speed-variable speech signal reproduction method in accordance with an embodiment of the present invention.
Figure 3:
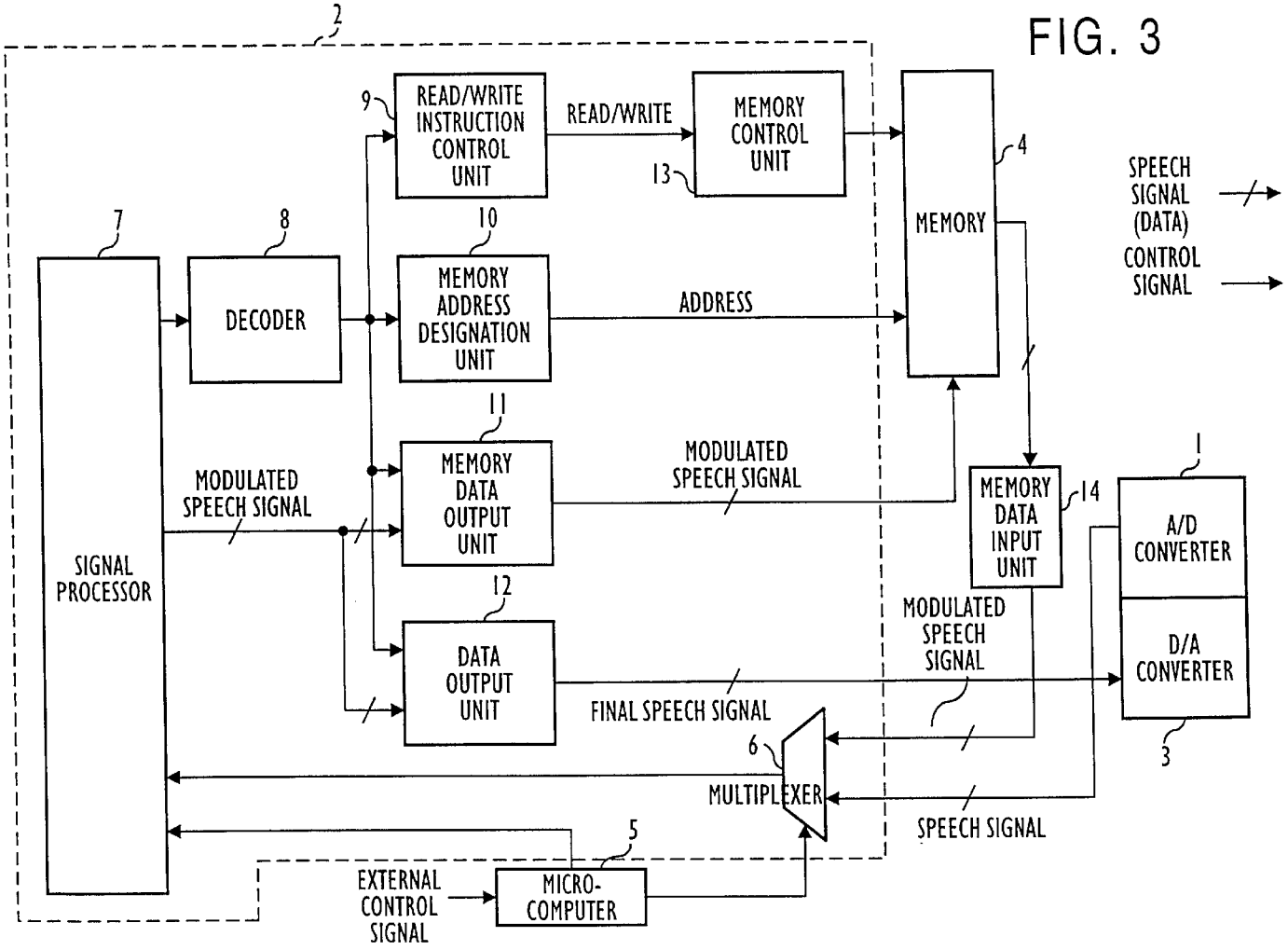
FIG. 3 is a detail block diagram further illustrating the embodiment shown FIG. 2.
Figure 4:
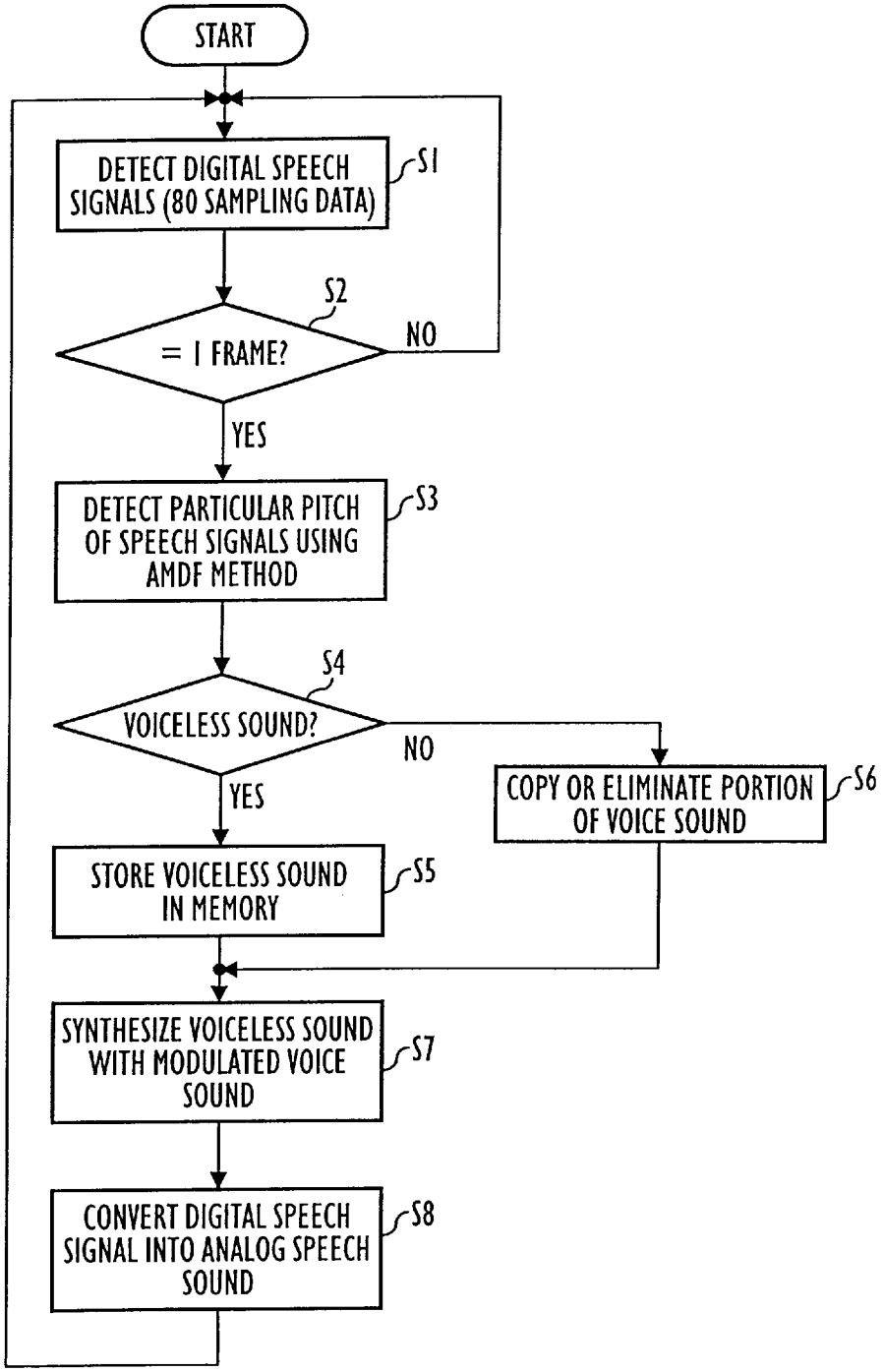

FIG. 4 is a flow chart illustrating the operation of a microcomputer for executing the speech signal reproduction in accordance with the embodiment of the present invention as shown in FIG. 2; and FIGS. 5A–5F are waveform diagrams respectively illustrating the speech signals which are modulated using the apparatus and method in accordance with the embodiment of the present invention as shown in FIGS. 2 through 4.

DETAILED DESCRIPTION OF THE PREFERRED EMBODIMENTS

A preferred embodiment of the speed-variable speech signal reproduction method and apparatus in accordance with the present invention will now be described with reference the attached drawings.

FIG. 2 is a block diagram illustrating an embodiment of a speed-variable speech signal reproduction apparatus used to perform the speed-variable speech signal reproduction method according to an embodiment of the present invention. The apparatus includes an analog/digital (A/D) converter 1 for converting an analog speech signal into a digital speech signal, and a digital signal processor 2 connected to the A/D converter 1. A digital/analog (D/A) converter 3 is coupled to the digital signal processor 2 to convert the digital signal processed by the signal processor into an analog speech signal. The apparatus further includes a memory 4 adapted to temporarily store the digital speech signal applied to the digital signal processor 2, and a microcomputer 5 adapted to control the digital signal processor 2 in accordance with a control signal externally applied thereto.

As shown in FIG. 3, the digital signal processor 2 includes a multiplexer 6 for simultaneously receiving the digital speech signal from the A/D converter 1 and a modified speech signal stored in the memory 4, and then selectively outputting one of those two speech signals under control of the microcomputer 5. A signal processor 7 is coupled to the output of the multiplexer 6. The signal processor 7 processes either the speech signal or modified speech signal output from the multiplexer 6, and thereby synthesizes selected portions of the signal. The signal processor 7 also controls the overall operation of the digital signal processor 2 under a control of the microcomputer 5.

A decoder 8 is coupled to the output of the signal processor 7, and a read/write instruction control unit 9, a memory address designation unit 10, a memory data output unit 11 and a data output unit 12 are coupled to the output of the decoder 8. The decoder 8 receives a control signal and sends it to a selected element of the digital signal processor 2, namely, the read/write instruction control unit 9, memory address designation unit 10, memory data output unit 11 and data output unit 12, as appropriate.

The read/write instruction control unit 9 checks, based on the control signal received from the decoder 8, whether the memory 4 is in a read state or write state, and outputs a read or write instruction based on the state of the memory 4. The memory address designation unit 10 designates the address corresponding to the memory location where data will be stored or from where data will be retrieved, in accordance with the control signal received from the decoder 8.

The memory data output unit 11 sends the modified speech signal processed through the signal processor 7 to the memory 4 in accordance with the control signal received from the decoder 8. The data output unit 12 sends the modified speech signal processed through the signal processor 7 to the digital/analog converter 3 in accordance with the control signal from the decoder 8.

The digital signal processor 2 also includes a memory control unit 13 which receives the read or write instruction from the read/write instruction unit 9 and controls an operation for recording a new speech signal in the memory 4 or retrieving the recorded speech signal. A memory data input unit 14 receives the data retrieved from the memory 4 and sends that retrieved data to the multiplexer 6.

The operation of the speed-variable speech reproduction apparatus according to the embodiment described above will now be described in detail with reference to FIGS. 4 and 5A–5F.

Figure 5A:
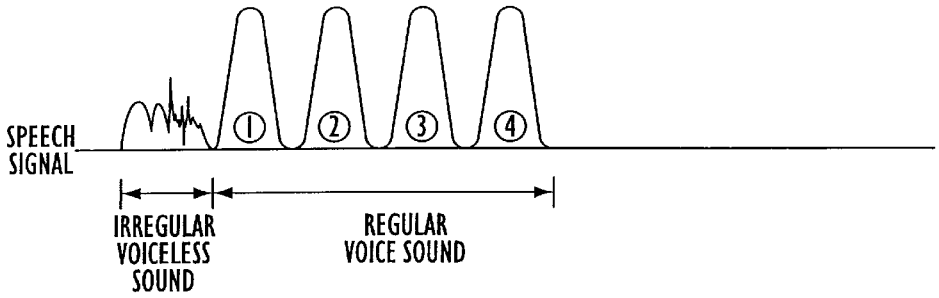

The microcomputer 5 initially samples digital speech signals, as shown in FIG. 5A, which are received from the A/D converter 1, and also outputs a control signal to the signal processor 7. It is assumed, for example, that one sampling data has a capacity of 16 bits, that the number of sampling data for every sampling is 80, and that signal processing is initiated when 160 speech signals are sampled, that is, when the number of sampling data corresponding to one frame has been received. Specifically, the microcomputer 5 controls the multiplexer 6 to apply digital a speech signal (80 sampling data) converted by the A/D converter 1 to the signal processor 7, as indicated in Step S1 of FIG. 4. The microcomputer 5 then detects the number of speech signals (sampling data) received by the signal processor 7, and determines in Step S2 whether the detected number of speech signals corresponds to one frame.

When it is determined in Step S2 that the received sampling data does not correspond to one frame, the microcomputer 5 returns to Step S1 and then applies a control signal to the multiplexer 6. In accordance with the control signal received from the microcomputer 5, the multiplexer 6 sends another digital speech signal (80 sampling data) received from the A/D converter 1 to the signal processor 7.

When it is finally determined in Step S2 that the number of received speech signals (sampling data) corresponds to one frame, the processing proceeds to Step S3 in which the microcomputer 5 controls the signal processor 7 to execute a signal processing procedure using the AMDF. Under the control of the microcomputer 5, the signal processor 7 then executes the AMDF signal processing procedure, thereby detecting a particular pitch of each of the speech signals (which each have 80 sampling data).

The AMDF method is a method for detecting a particular pitch of speech signals using a window function. In this case, where the speech signals have a particular pitch, they are determined to be a voice sound. On the other hand, where the speech signals do not have a particular pitch, they are determined to be a voiceless sound. Such an AMDF method can be expressed by the following equation:

$$\Gamma\bar{n}(k) = \sum_{m=0}^{\infty} |x(n+m)\omega 1(m) - x(n+m-k)\omega 2(m-k)|$$

$$\omega(m) = \begin{cases} 1 & \text{if } 0 \leqq m \leqq N \\ 0 & \text{if not} \end{cases}$$

where,

N: a certain segment of a window function;

m: the sampling position; and k: the time constant corresponding to the particular speech signal pitch to be detected.

Figure 5B:
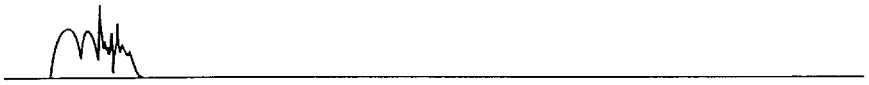

When a particular component of a speech signal is detected in the above procedure, it is then determined in Step S4 whether the corresponding speech signal portion corresponds to a voiceless sound. If it is determined that the speech signal portion corresponds to a voiceless sound, as shown in FIG. 5B, the microcomputer 5 applies a control signal to the signal processor 7 which, in turn, outputs that speech signal portion corresponding to the voiceless sound without processing that speech signal portion. The signal processor 7 further applies a control signal to the decoder 8, which controls the read/write instruction control unit 9, memory address designation unit 10, and memory data output unit 11 to store that output speech signal portion in the memory 4.

Specifically, the read/write instruction unit 9 outputs a write instruction for storing that output speech signal portion in the memory 4. This control signal from the read/write instruction unit 9 is applied to the memory control unit 13 and then to the memory 4. Also, the memory address designation unit 10 outputs an address corresponding to the memory location where the data representing that speech signal portion corresponding to the voiceless sound is to be stored. Thus, the memory 4 stores the data representing the voiceless sound output from the memory data output unit 11 at the memory location corresponding to the address designated by the memory address designation unit 10.

Figure 5C:
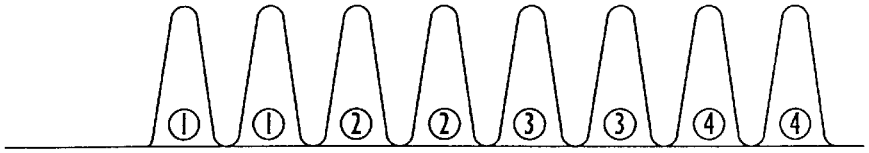
Figure 5D:
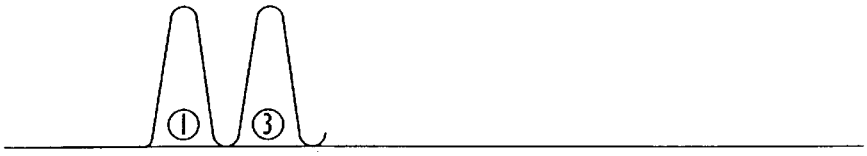

On the other hand, if it is determined in Step S4 that the speech signal portion with the periodic component does not correspond to a voiceless sound, the microcomputer 5 applies a control signal to the signal processor 7 to process that speech signal portion. That is, in Step S6, the signal processor 7 copies, as shown in FIG. 5C, or eliminates, as shown in FIG. 5D, that portion of the speech signal corresponding to a voice sound, thereby modulating the length of the voice sound.

However, when a one-pitch portion of the speech signal is synthesized with another one-pitch speech signal portion in the modulation procedure performed by copying or eliminating a part of the voice sound, an inter-signal strike may occur at joint portions of the speech signal, thereby forming undesirable ripple components. In order to prevent such a phenomenon, the signal modulation is carried out by applying a desired window function to each signal component. The window function can be expressed by the following equation:

$$x_m(n) = h_m(t_m - n)x(n)$$

where, $x_m(n)$: a modulated speech signal;

$h_m(n)$: the window function;

$t_m$: the position of each speech source; and x(n): an input speech signal (the amount of speech on a time axis n).

After the signal modulation has been completed, the microcomputer 5 applies a control signal to the signal processor 7 which, in turn, applies a control signal to the decoder 8 to retrieve the voiceless sound data stored in the memory 4. In accordance with the control signal from the signal processor 7, the decoder 8 controls the read/write instructions unit 9 to output a read instruction. The read instruction is sent to the memory 4 through the memory control unit 13.

The decoder 8 also applies a control signal to the memory address designation unit 10 in order to output the address associated with the voiceless sound data stored in the memory 4. Thus, the memory 4 outputs the voiceless sound data stored in the designated memory location thereof. The voiceless sound data output from the memory 4 is sent to the multiplexer 6 via the memory data input unit 14. The microcomputer 5 applies a control signal to the multiplexer 6 so that the voiceless sound data output from the memory 4 can be received by the signal processor 7.

Figure 5E:
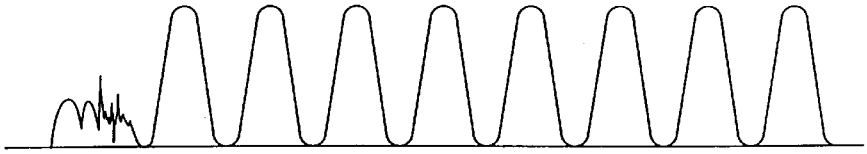
Figure 5F:
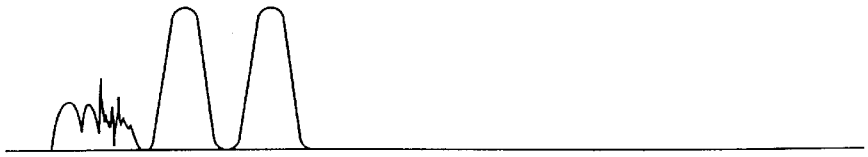

In Step S7, the signal processor 7 then synthesizes the received voiceless sound data with the voice sound data, as shown in FIGS. 5C or 5D, which has been modulated in accordance with the above-described signal processing procedure. The resultant speech signal obtained after the signal synthesis operation is performed is shown in FIGS. 5E and 5F. That is, the signal shown in FIG. 5E represents the synthesis of the voiceless sound data and the modulated voice sound data shown in FIG. 5C, and the signal shown in FIG. 5F represents the synthesis of the voiceless sound data and the modulated voice sound data shown in FIG. 5D. The synthesized speech signal is then sent to the data output unit 12 which, in turn, sends the speech signal to the D/A converter 3 in accordance with a control signal from the decoder 8. The speech signal x(n) finally obtained after the signal synthesis is expressed by the following equation:

$$x(n) = \frac{\sum_q \alpha_q x_q(n) h_q(t_q - n)}{\sum_q h_q^2(t_q - n)}$$

where, $\alpha_q$: a variable for adjusting the amount of synthesized speech;

x(n): a modulated speech characteristic ($x(n)=x(n-\delta_q)$);

$t_q(n)$: the position of each modulated speech source; and $\delta_q$: a variable for determining the play-back speed.

In Step S8, the D/A converter 3 converts the digital speech signal output from the signal processor 7 into an analog speech signal and then outputs that analog speech signal. Thus, the user can hear speech signals at a varied play-back speed without any degradation in tone or loss of speech signals.

As apparent from the above description, the present invention provides a speed-variable speech reproduction method capable of preventing any degradation in the tone or loss of speech signals being played back by an speech reproduction apparatus even when the speech signal play-back speed varies, thereby providing an improved service to the user. Furthermore, even though the present invention has been described as being usable with a speech signal reproduction apparatus, it certainly can be employed in multimedia equipment in which high-speed scanning is performed.

Although the preferred embodiments of the invention have been disclosed for illustrative purposes, those skilled in the art will appreciate that various modifications and additions are possible without departing from the scope and spirit of the invention as disclosed in the accompanying claims.

What is claimed is:

1. A speed-variable speech signal reproduction method using a signal processor adapted to receive and process digital speech signals, a memory adapted to store the digital speech signals processed by the signal processor, and a microcomputer adapted to control both the signal processor and memory, the method comprising the steps of:

(a) detecting a pitch of the digital speech signals;

(b) separating voice and voiceless sounds of the speech signals from each other based on the result of the detecting step;

(c) temporarily storing the voiceless sound separated in the separating step;

(d) modulating the lengths of the speech signals by copying or eliminating a part of the voice sound separated in the separating step; and (e) synthesizing the voice sound modulated in the modulating step with the voiceless sound temporarily stored in the memory in the temporarily storing step;

wherein the detection of the pitch of the speech signals performed in the detecting step is achieved using the following equation:

$$\Gamma - n(k) = \sum_{m=0}^{\infty} |x(n+m)\omega 1(m) - x(n+m-k)\omega 2(m-k)|$$

$$\omega(m) = \begin{cases} 1 & \text{if } 0 \leqq m \leqq N \\ 0 & \text{if not} \end{cases}$$

where,

N: a certain segment of a window function;

m: the sampling position;

k: the time constant corresponding to the particular speech signal pitch to be detected.

2. A speed-variable speech signal reproduction method using a signal processor adapted to receive and process digital speech signals, a memory adapted to store the digital speech signals processed by the signal processor, and a microcomputer adapted to control both the signal processor and memory, the method comprising the steps of:

(a) detecting a pitch of the digital speech signals;

(b) separating voice and voiceless sounds of the speech signals from each other based on the result of the detecting step;

(c) temporarily storing the voiceless sound separated in the separating step;

(d) modulating the lengths of the speech signals by copying or eliminating a part of the voice sound separated in the separating step; and (e) synthesizing the voice sound modulated in the modulating step with the voiceless sound temporarily stored in the memory in the temporarily storing step;

wherein the synthesis of the modulated voice sound with the voiceless sound carried out at the fifth step is achieved using the following equation:

$$x(n) = \frac{\sum_{q} \alpha_q x_q(n) h_q(t_g - n)}{\sum_{q} h2_q(t_q - n)}$$

where, $\alpha_q$: a variable for adjusting the amount of synthesized speech; a modulated speech;

x(n): a modulated speech characteristic ($x(n)=x(n-\delta_q)$);

$t_q(n)$: the position of each modulated speech source; and $\delta_q$: a variable for determining the play-back speed.

3. A speed-variable speech signal reproduction apparatus, comprising:

a detector which detects a pitch of the digital speech signals;

a separator which separates voice and voiceless sounds of the speech signals from each other based on the pitch detected by the detector;

a memory adapted to temporarily store the voiceless sound separated by the separator;

a modulator which modulates the lengths of the speech signals by copying or eliminating a part of the voice sound separated in the separating step; and a synthesizer which synthesizes the voice sound modulated by the modulator with the voiceless sound temporarily stored in the memory;

wherein the detection of the pitch of the speech signals performed in the detector is achieved using the following equation:

$$\Gamma - n(k) = \sum_{m=0}^{\infty} |x(n+m)\omega 1(m) - x(n+m-k)\omega 2(m-k)|$$

$$\omega(m) = \begin{cases} 1 & \text{if } 0 \leqq m \leqq N \\ 0 & \text{if not} \end{cases}$$

where,

N: a certain segment of a window function;

m: the sampling position;

k: the time constant corresponding to the particular speech signal pitch to be detected.

4. A speed-variable speech signal reproduction apparatus, comprising:

a detector which detects a pitch of the digital speech signals;

a separator which separates voice and voiceless sounds of the speech signals from each other based on the pitch detected by the detector;

a memory adapted to temporarily store the voiceless sound separated by the separator;

a modulator which modulates the lengths of the speech signals by copying or eliminating a part of the voice sound separated in the separating step; and a synthesizer which synthesizes the voice sound modulated by the modulator with the voiceless sound temporarily stored in the memory;

wherein the synthesis of the modulated voice sound with the voiceless sound performed by the synthesizer is achieved using the following equation:

$$x(n) = \frac{\sum_q \alpha_q x_q(n) h_q(t_g - n)}{\sum_q h2_q(t_q - n)}$$

where, $\alpha_q$: a variable for adjusting the amount of synthesized speech; a modulated speech;

x(n): a modulated speech characteristic ($x(n)=x(n-\delta_q)$);

$t_q(n)$: the position of each modulated speech source; and $\delta_q$: a variable for determining the play-back speed.

* * * * *